US009690240B1

(12) United States Patent
Matsushima et al.

(10) Patent No.: US 9,690,240 B1
(45) Date of Patent: Jun. 27, 2017

(54) FIXING DEVICE, IMAGE FORMING APPARATUS, AND NON-TRANSITORY COMPUTER READABLE MEDIUM

(71) Applicant: FUJI XEROX CO., LTD., Tokyo (JP)

(72) Inventors: Motoki Matsushima, Kanagawa (JP); Masahiro Katahira, Kanagawa (JP); Yuki Nagamori, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 15/209,840

(22) Filed: Jul. 14, 2016

(30) Foreign Application Priority Data

Feb. 25, 2016 (JP) ..... 2016-034532

(51) Int. Cl.
*G03G 15/20* (2006.01)

(52) U.S. Cl.
CPC ..... *G03G 15/2039* (2013.01); *G03G 15/2025* (2013.01)

(58) Field of Classification Search
CPC ..... G03G 15/2025; G03G 15/2039
USPC ..... 399/69, 327
See application file for complete search history.

(56) References Cited

U.S. PATENT DOCUMENTS 5,749,037 A * 5/1998 Takayuki ..... G03G 15/2025 399/327
8,918,039 B2 * 12/2014 Arikawa et al. ... G03G 15/2025 399/327

FOREIGN PATENT DOCUMENTS

JP 2003-57985 A 2/2003
JP 2010-139883 A 6/2010
JP 2012-63374 A 3/2012

* cited by examiner

*Primary Examiner* — William J Royer
(74) *Attorney, Agent, or Firm* — Sughrue Mion, PLLC

(57) ABSTRACT

A fixing device includes a fixing member, a first roller, a second roller, a detector, and an adjustment unit. The fixing member fixes, on a recording medium, a toner image formed on the recording medium. The first roller performs cleaning of toner sticking to a surface of the fixing member. The second roller collects the toner sticking to a surface of the first roller. The detector detects a temperature of the second roller. The adjustment unit adjusts the temperature of the second roller on a basis of a result of detection performed by the detector.

8 Claims, 11 Drawing Sheets

JUDGING LEVEL 3 OR HIGHER AS IMAGE DEFECT

0: NO SMEAR
1: ONE OR LESS SPOT SMEAR IN $\phi$0.2 mm
2: TWO OR MORE SPOT SMEARS IN $\phi$0.2 mm
3: CLUSTERS OF SPOT SMEARS IN $\phi$0.2 mm
4: ONE OR LESS SPOT SMEAR IN $\phi$0.25 mm
5: TWO OR MORE SPOT SMEARS IN $\phi$0.25 mm

FIXING DEVICE, IMAGE FORMING APPARATUS, AND NON-TRANSITORY COMPUTER READABLE MEDIUM

CROSS-REFERENCE TO RELATED APPLICATIONS

This application is based on and claims priority under 35 USC 119 from Japanese Patent Application No. 2016-034532 filed Feb. 25, 2016.

BACKGROUND

Technical Field

The present invention relates to a fixing device, an image forming apparatus, and a non-transitory computer readable medium.

SUMMARY

According to an aspect of the invention, there is provided a fixing device including a fixing member, a first roller, a second roller, a detector, and an adjustment unit. The fixing member fixes, on a recording medium, a toner image formed on the recording medium. The first roller performs cleaning of toner sticking to a surface of the fixing member. The second roller collects the toner sticking to a surface of the first roller. The detector detects a temperature of the second roller. The adjustment unit adjusts the temperature of the second roller on a basis of a result of detection performed by the detector.

BRIEF DESCRIPTION OF THE DRAWINGS

Exemplary embodiments of the present invention will be described in detail based on the following figures, wherein.

DETAILED DESCRIPTION

Figure 1:
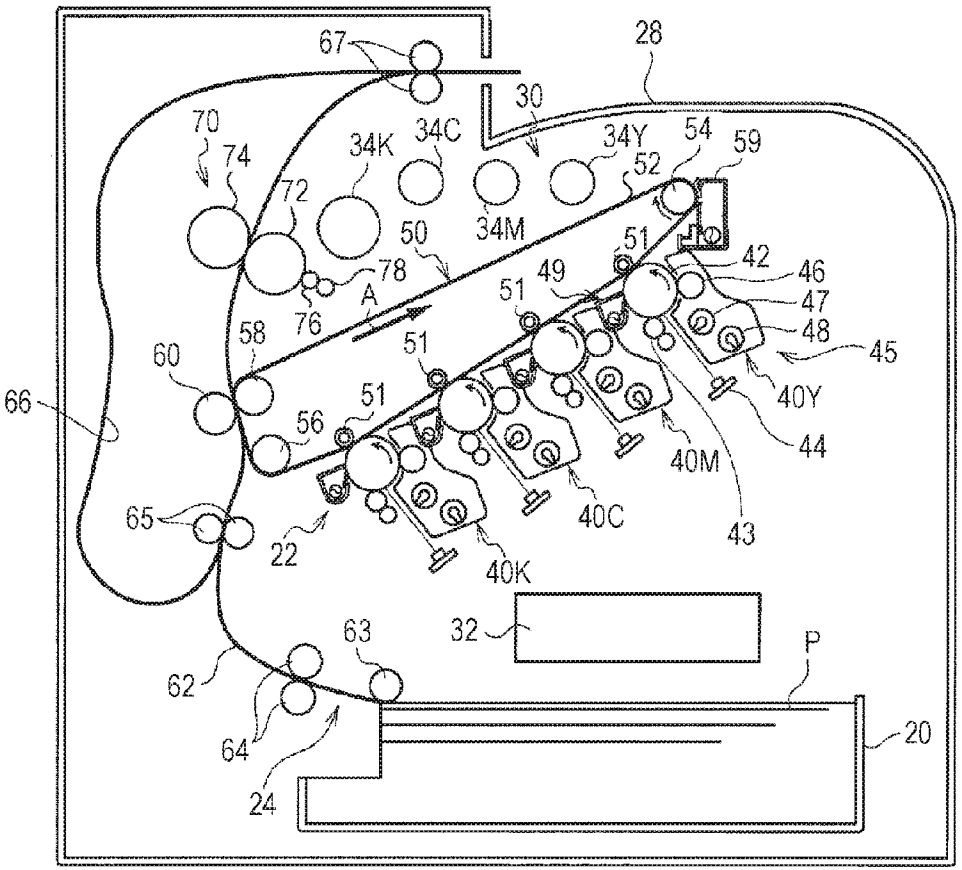
FIG. 1 is a diagram schematically illustrating a configuration overview of an image forming apparatus according to a first exemplary embodiment.

Hereinafter, examples of exemplary embodiments will be described in detail with reference to the drawings.

First Exemplary Embodiment

The configuration of an imaging device 10 according to an exemplary embodiment will be described with reference to FIG. 1. In the following description, Y denotes yellow, M denotes magenta, C denotes cyan, and K denotes black. If components and toner images (images) need to be discriminated based on color, one of references (C, M, Y, and K) for the colors is suffixed to the corresponding reference numeral. If the components and the toner images are collectively referred to without being discriminated based on color, the references for the colors to be suffixed to the respective reference numerals are omitted.

The imaging device 10 includes a sheet container 20 that contains sheets P that are recording media, a toner-image forming section 22, a transportation section 24, a discharging section 28, a refilling mechanism 30, a controller 32, and a fixing device 70.

The toner-image forming section 22 includes imaging units 40 and a first transfer unit 50. Each imaging unit 40 includes an image holder 42, a charger 43, an exposure device 44, a developing device 45, and a remover 49. Each of the imaging units 40C, 40M, 40Y, and 40K forms a toner image in a corresponding one of the colors C, M, Y, and K on the circumferential surface of the corresponding image holder 42.

The charger 43 charges the circumferential surface of the image holder 42. The exposure device 44 radiates exposure light to the circumferential surface of the image holder 42 charged by the charger 43 and thereby forms a latent image. The developing device 45 develops the latent image formed on the image holder 42 by using a developer (for example, negative charged toner) and makes the latent image visible as a toner image. The developing device 45 includes a toner supplier 46 that supplies the toner to the circumferential surface of the image holder 42 and two transportation members 47 and 48 that transport the toner and the developer containing carriers to the toner supplier 46. The developing devices 45 for the respective colors are connected to toner cartridges 34 through refilling pipes (not illustrated), respectively. The four toner cartridges 34 (34C, 34M, 34Y, and 34K) are filled with the toner to be refilled in the respective developing devices 45 and are arranged for the respective colors along the width of the imaging device 10 in such a manner as to be detachable from the imaging device 10. The toner cartridges 34 for the respective colors are each shaped into a column extending along the depth of the imaging device 10. Further, the remover 49 removes, from the circumferential surface of the image holder 42, the toner, an additive, and the like that remain on the circumferential surface of the image holder 42 without undergoing the first transfer after the toner image formed on the circumferential surface of the image holder 42 undergoes the first transfer onto an intermediate transfer belt 52 that is an example of an image holder.

The first transfer unit 50 includes the endless intermediate transfer belt 52 and a driving roller 54 around which the intermediate transfer belt 52 is wound. The driving roller 54 is rotated by a motor (not illustrated) and causes the intermediate transfer belt 52 to move in an arrow A direction. The first transfer unit 50 also includes a tension roller 56 around which the intermediate transfer belt 52 is wound and an auxiliary roller 58. The tension roller 56 tensions the intermediate transfer belt 52, and the auxiliary roller 58 is rotated in accompany with the intermediate transfer belt 52. The first transfer unit 50 also includes first transfer rollers 51 that are each disposed to face the corresponding color image holder 42 across the intermediate transfer belt 52.

With the configuration described above, the C, M, Y, and K toner images serially formed on the respective image holders 42 of the imaging units 40 for the respective colors are transferred in an overlapping manner onto the intermediate transfer belt 52 by the first transfer rollers 51 for the respective colors.

A cleaning device 59 removes, from the circumferential surface of the intermediate transfer belt 52, the toner, the additive, and the like that are not fixed in the second transfer and thus remain on the circumferential surface of the intermediate transfer belt 52 after the toner image on the circumferential surface of the intermediate transfer belt 52 undergoes the second transfer onto one of the sheets P.

In addition, a second transfer roller 60 is disposed to face the auxiliary roller 58 across the intermediate transfer belt 52. The second transfer roller 60 transfers the toner image transferred on the intermediate transfer belt 52 onto the transported sheet P. The second transfer roller 60 is grounded, and the auxiliary roller 58 forms a counter electrode for the second transfer roller 60. When a second transfer voltage is applied, the toner image is transferred onto the sheet P by using the auxiliary roller 58.

The transportation section 24 includes a feed roller 63 that feeds each sheet P stacked in the sheet container 20 to a transport path 62, separation rollers 64 that separate, one by one, the sheet P fed by the feed roller 63, and registration rollers 65 that times the transportation of the sheet P. The feed roller 63, the separation rollers 64, and the registration rollers 65 are arranged on the transport path 62 in this order in a transportation direction of the sheet P.

The rotating registration rollers 65 feed each sheet P supplied from the sheet container 20 to a contact portion between the intermediate transfer belt 52 and the second transfer roller 60 (a second transfer position) at scheduled timing.

Further, the sheet P is transported to the fixing device 70, and the fixing device 70 fixes the toner image on one of the surfaces (image-formed surface) of the sheet P.

Figure 2:
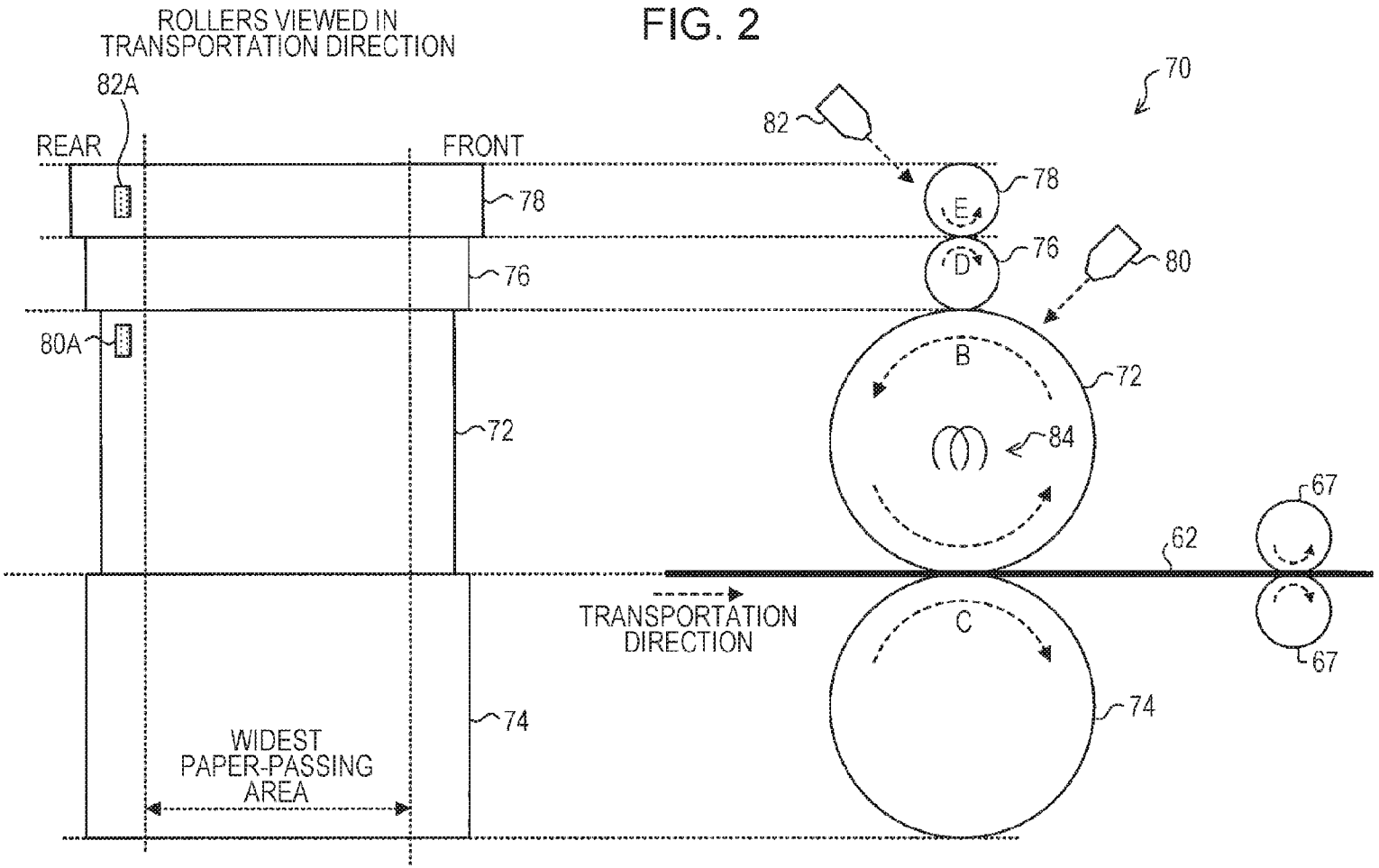
FIG. 2 is a diagram schematically illustrating a configuration overview of a fixing device of the image forming apparatus according to the first exemplary embodiment.

The fixing device 70 of the exemplary embodiment will be described with reference to FIG. 2. The fixing device 70 of the exemplary embodiment includes a fixing roller 72, a pressure roller 74, a cleaning roller 76, and a collection roller 78.

The fixing roller 72, the pressure roller 74, the cleaning roller 76, and the collection roller 78 are columnar rollers that extend from the front of the imaging device 10 toward the rear (the depth end) and are rotated about the rotary axis that extends in a direction orthogonal to the transportation direction of the sheet P.

The fixing roller 72 is rotated by a motor 110 (see FIG. 3) in an arrow B direction. The fixing roller 72 has a heater 84 incorporated in the fixing roller 72 and heats the sheet P transported on the transport path 62. The fixing roller 72 of the exemplary embodiment is an example of a fixing member.

Figure 3:
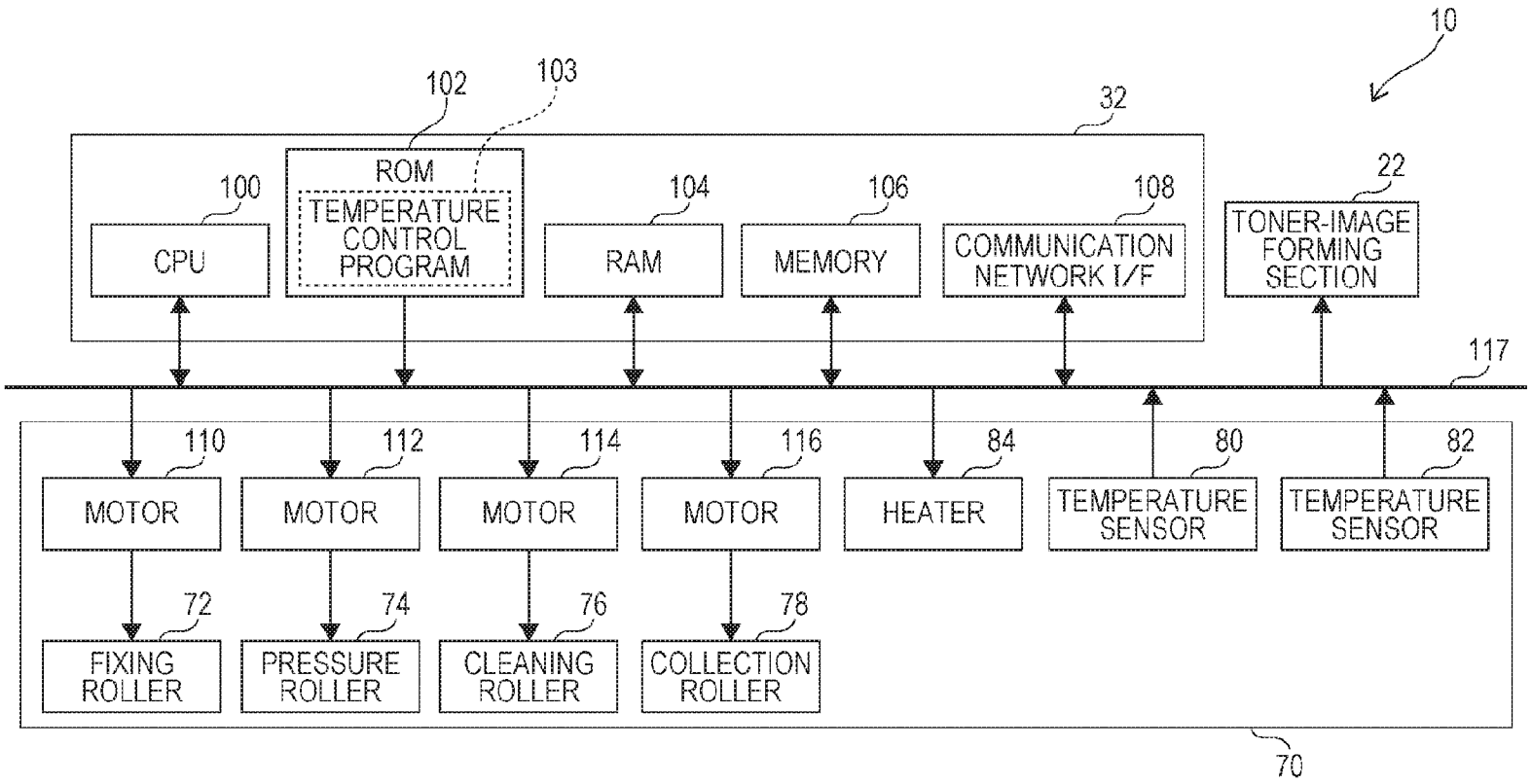
FIG. 3 is a block diagram illustrating the configuration of a principal part of an electrical system of the image forming apparatus according to the first exemplary embodiment.

The pressure roller 74 is disposed to face the fixing roller 72 across the transport path 62 and is rotated in an arrow C direction by a motor 112 (see FIG. 3). The pressure roller 74 presses the sheet P transported on the transport path 62.

The cleaning roller 76 is in contact with the fixing roller 72 and rotated in an arrow D direction by a motor 114 (see FIG. 3). The cleaning roller 76 removes (performs cleaning of) the toner, a foreign substance, and the like sticking to the surface of the fixing roller 72. The size (a diameter $\phi$) of the cleaning roller 76 is not particularly limited but is set smaller than that of the fixing roller 72 in the exemplary embodiment. The material of the cleaning roller 76 is not particularly limited as long as the material does not damage the surface of the fixing roller 72 in the cleaning. The cleaning roller 76 of the exemplary embodiment is an example of a first roller.

The collection roller 78 is in contact with the cleaning roller 76 and rotated in an arrow E direction by a motor 116 (see FIG. 3). The collection roller 78 collects and holds the toner, a foreign substance, and the like sticking to the surface of the cleaning roller 76. The size (a diameter $\phi$) of the collection roller 78 is not particularly limited, but in the exemplary embodiment, the size is set smaller than that of the fixing roller 72 and also is set equal to or slightly smaller than that of the cleaning roller 76. The material of the collection roller 78 is not particularly limited as long as the collection roller 78 collects and holds the toner, the foreign substance, and the like. The collection roller 78 of the exemplary embodiment is an example of a second roller.

The fixing device 70 also includes temperature sensors 80 and 82. The temperature sensor 80 detects the temperature of the surface of the fixing roller 72. In the exemplary embodiment, as illustrated as a detection position 80A in FIG. 2 that is viewed in the transportation direction, the temperature sensor 80 detects the temperature of a portion outside an area (the widest paper-passing area) of the surface of the fixing roller 72 through which the sheet P passes. More specifically, the detection position 80A is located upstream of a nip (contact portion) with the cleaning roller 76 in a direction of the rotation of the fixing roller 72 and in a rear portion of the imaging device 10. The temperature sensor 82 detects the temperature of the surface of the collection roller 78. In the exemplary embodiment, as illustrated as a detection position 82A in FIG. 2 that is viewed in the transportation direction, the temperature sensor 82 detects the temperature of a portion outside an area (the widest paper-passing area) of the surface of the collection roller 78 through which the sheet P passes. More specifically, the detection position 82A is located upstream of a nip (contact portion) with the cleaning roller 76 in a direction of the rotation of the collection roller 78 and in the rear portion of the imaging device 10.

The temperature sensors 80 and 82 are not particularly limited as long as the temperature sensors 80 and 82 respectively detect the temperatures of the surfaces of the fixing roller 72 and the collection roller 78. However, the temperature sensors 80 and 82 preferably detect the temperatures in such a manner as not to be in contact with the fixing roller 72 and the collection roller 78, respectively. For example, the temperature sensors 80 and 82 are each preferably an infrared radiation thermometer or the like.

As illustrated in FIG. 1, the transportation section 24 of the imaging device 10 of the exemplary embodiment is provided with a reverse transportation section 66 that transports the sheet P turned over to further form an image on each side of the sheet P. The reverse transportation section 66 reverses the transportation direction of the sheet P on which the fixing device 70 fixes the toner image. Thereafter, the reverse transportation section 66 transports the sheet P to the second transfer position to cause the back side of the sheet P to face the circumferential surface of the intermediate transfer belt 52.

The discharging section 28 is disposed downstream of the fixing device 70 in the transportation direction of the sheet P and on the outer and upper surface of the imaging device 10. The sheet P on which the fixing device 70 fixes the toner image is discharged by discharge rollers 67 to the discharging section 28.

A process for forming an image by the imaging device 10 illustrated in FIGS. 1 and 2 (image formation process) is performed in the following manner.

First, the controller 32 serially outputs pieces of tone data for the respective colors to the respective exposure devices 44. Exposure light emitted from each exposure device 44 in accordance with the corresponding piece of the tone data is radiated onto the surface of the corresponding image holder 42 charged by the charger 43. An electrostatic latent image is thereby formed on the surface of the image holder 42. The electrostatic latent image formed on the image holder 42 is developed by the developing device 45 in the corresponding color and made visible as a toner image in a corresponding one of the colors of C, M, Y, and K.

Further, each color toner image formed on the image holder 42 is transferred onto the rotating intermediate transfer belt 52 in the overlapping manner by the first transfer roller 51 of the first transfer unit 50.

Each color toner image transferred onto the intermediate transfer belt 52 in the overlapping manner undergoes the second transfer onto the sheet P transferred along the transport path 62 from the sheet container 20 by using the feed roller 63, the separation rollers 64, and the registration rollers 65. The second transfer is performed by the second transfer roller 60 at the second transfer position.

Further, the sheet P having the toner image transferred thereon is transported to the fixing device 70. The fixing device 70 then fixes the toner image on the sheet P. The sheet P having the toner image fixed thereon is discharged to the discharging section 28 by the discharge rollers 67.

If images are to be formed on both surfaces of the sheet P, the discharge rollers 67 do not discharge, to the discharging section 28 at this stage, the sheet P one of the surfaces (a front surface) on which the fixing device 70 fixes the toner image. The discharge rollers 67 are reversely rotated to thereby switch the transportation direction of the sheet P. The sheet P is transported by the reverse transportation section 66 and is again transported to the registration rollers 65 with the surfaces being upside down. The sheet P undergoes transfer and fixing of a toner image on the other surface (a back surface) and is thereafter discharged to the discharging section 28 by the discharge rollers 67.

Subsequently, the configuration of a principal part of an electrical system of the imaging device 10 of the exemplary embodiment will be described with reference to FIG. 3.

As illustrated in FIG. 3, the controller 32 according to the exemplary embodiment includes a central processing unit (CPU) 100, a read only memory (ROM) 102, a random access memory (RAM) 104, a nonvolatile memory 106 such as a flash memory, and a communication network interface (I/F) 108. The CPU 100 controls the overall operation of the imaging device 10. The ROM 102 in advance stores various programs including a temperature control program 103 (described later in detail), various parameters, and the like. The RAM 104 is used as a work area or the like for the CPU 100 to run the various programs. The communication network I/F 108 exchanges communication data with an external device.

The CPU 100, the ROM 102, the RAM 104, the memory 106, the communication network I/F 108, the motors 110, 112, 114, and 116, the temperature sensors 80 and 82, and the heater 84 are connected to each other through a bus 117 including an address bus, a data bus, a control bus, and other buses.

With the configuration illustrated in FIG. 3 of the imaging device 10 of the exemplary embodiment, the CPU 100 accesses to the ROM 102, the RAM 104, and the memory 106 and exchanges communication data with the external device through the communication network I/F 108.

The CPU 100 controls the motors 110, 112, 114, and 116 to thereby control the rotation of the fixing roller 72, the pressure roller 74, the cleaning roller 76, and the collection roller 78, respectively. The CPU 100 also controls the heater 84 to thereby heat the fixing roller 72. The CPU 100 (controller 32) and the heater 84 of the exemplary embodiment are each an example of an adjustment unit of the exemplary embodiment.

Further, the CPU 100 acquires a detection signal output from the temperature sensor 80 to thereby detect a temperature t(H/R) of the fixing roller 72. The CPU 100 acquires a detection signal output from the temperature sensor 82 to thereby detect a temperature t(W/R) of the collection roller 78.

Subsequently, actions of the imaging device 10 of the exemplary embodiment will be described. In the imaging device 10 of the exemplary embodiment, the controller 32 controls the temperature of the collection roller 78 of the fixing device 70 and the temperature of the fixing device 70 so as to restrain the toner collected by the collection roller 78 from causing a defect in the image quality of an image (toner image) fixed on the sheet P. Hereinafter, an operation for controlling the temperature of the fixing device 70 performed by the controller 32 will be described.

Figure 4:
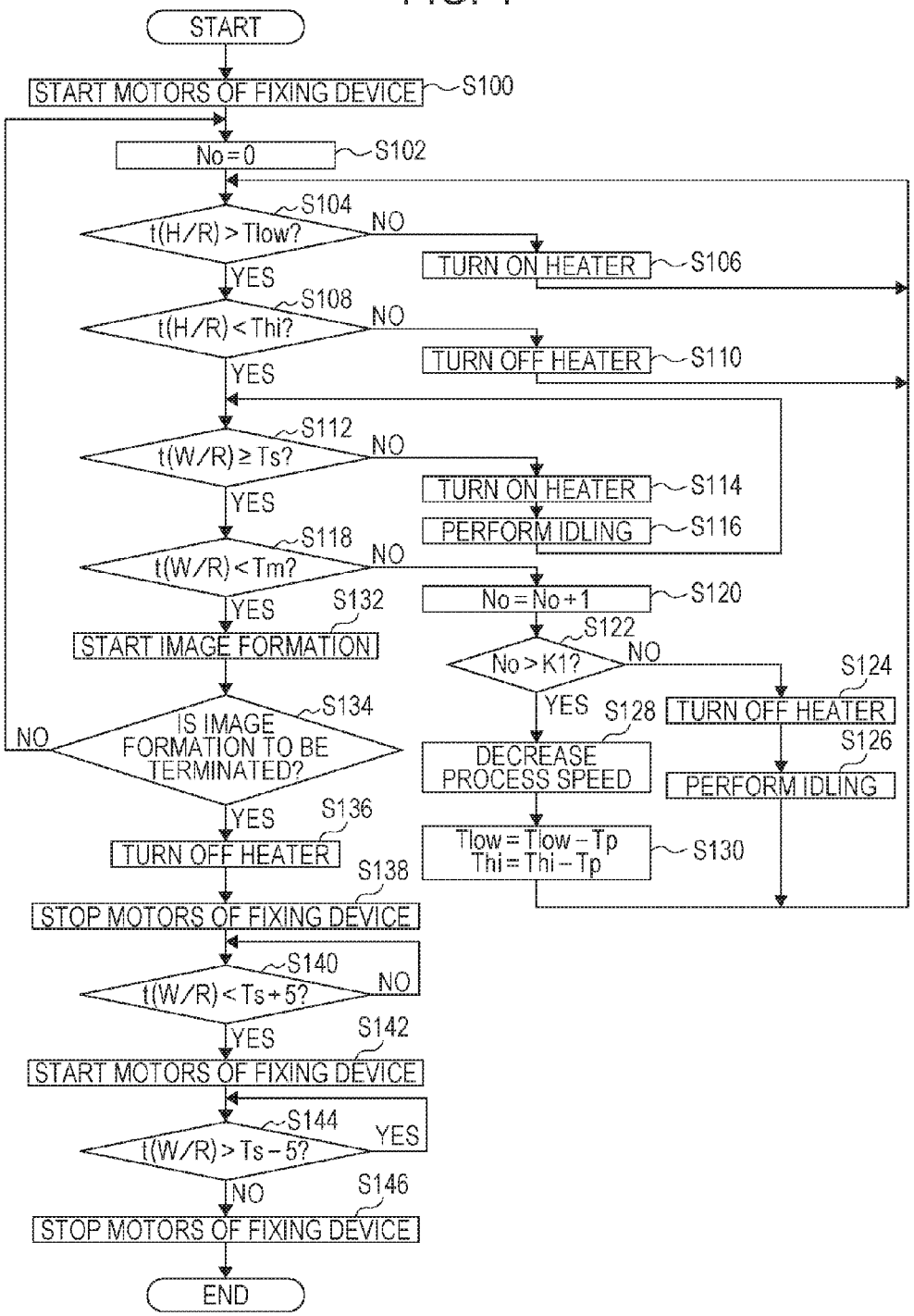
FIG. 4 is a flowchart illustrating the flow of a temperature control process executed by a controller of the image forming apparatus according to the first exemplary embodiment.

FIG. 4 is a flowchart illustrating the flow of a process for controlling the temperature of the fixing device 70 performed by the controller 32 according to the exemplary embodiment. When the CPU 100 runs the temperature control program 103 installed in advance in the ROM 102, the temperature control process illustrated in FIG. 4 is thereby performed. In addition, when the imaging device 10 receives an instruction for forming an image on the sheet P, the temperature control process illustrated in FIG. 4 is executed. Note that the instruction causes the entire imaging device 10 (including the toner-image forming section 22, the first transfer unit 50, and other components) to start operations, but the image formation is not started at this stage.

In step S100, the controller 32 starts the motors 110, 112, 114, and 116 of the fixing device 70. The fixing roller 72, the pressure roller 74, the cleaning roller 76, and the collection roller 78 thereby start rotation.

In subsequent step S102, the controller 32 sets, to 0 (No=0), a variable No for counting the number of times the process is performed (described later in detail).

In subsequent step S104, the controller 32 acquires the temperature t(H/R) of the fixing roller 72 from the temperature sensor 80 and judges whether the temperature t(H/R) exceeds a lower limit Tlow of the temperature of the fixing roller 72 (t(H/R)>Tlow). In the imaging device 10 of the exemplary embodiment, the lower limit Tlow and an upper limit Thi of the temperature t(H/R) of the fixing roller 72 are in advance acquired based on experiments. The lower limit Tlow and the upper limit Thi are needed to fix a toner image on the sheet P and are determined based on, for example, the types of the toner and the sheet P, and the configuration of the toner-image forming section 22. The controller 32 controls the temperature t(H/R) of the fixing roller 72 to be higher than the lower limit Tlow and lower than the upper limit Thi (Tlow<t(H/R)<Thi) when the toner image is formed.

If the temperature t(H/R) does not exceed the lower limit Tlow, the judgment has a negative result, and the process moves to step S106. In step S106, the controller 32 turns on the heater 84 to heat the fixing roller 72, and the process thereafter returns to step S104. If the heater 84 has been turned on, the controller 32 maintains the on state in step S106. If the temperature t(H/R) exceeds the lower limit Tlow, the judgment has an affirmative result, and the process moves to step S108.

In step S108, the controller 32 acquires the temperature t(H/R) of the fixing roller 72 from the temperature sensor 80, and judges whether the temperature t(H/R) is lower than the upper limit Thi (t(H/R)<Thi). If the temperature t(H/R) is not lower than the upper limit Thi, the judgment has a negative result, and the process moves to step S110. In step S110, the controller 32 turns off the heater 84 and stops heating the fixing roller 72, and the process thereafter returns to step S104. If the heater 84 has been turned off, the controller 32 maintains the off state in step S110. If the temperature t(H/R) is lower than the upper limit Thi, the judgment has an affirmative result, and the process moves to step S112.

In step S112, the controller 32 acquires the temperature t(W/R) of the collection roller 78 from the temperature sensor 82 and judges whether the temperature t(W/R) is equal to or higher than a softening temperature Ts of the toner (t(W/R)≥Ts).

Figure 5:
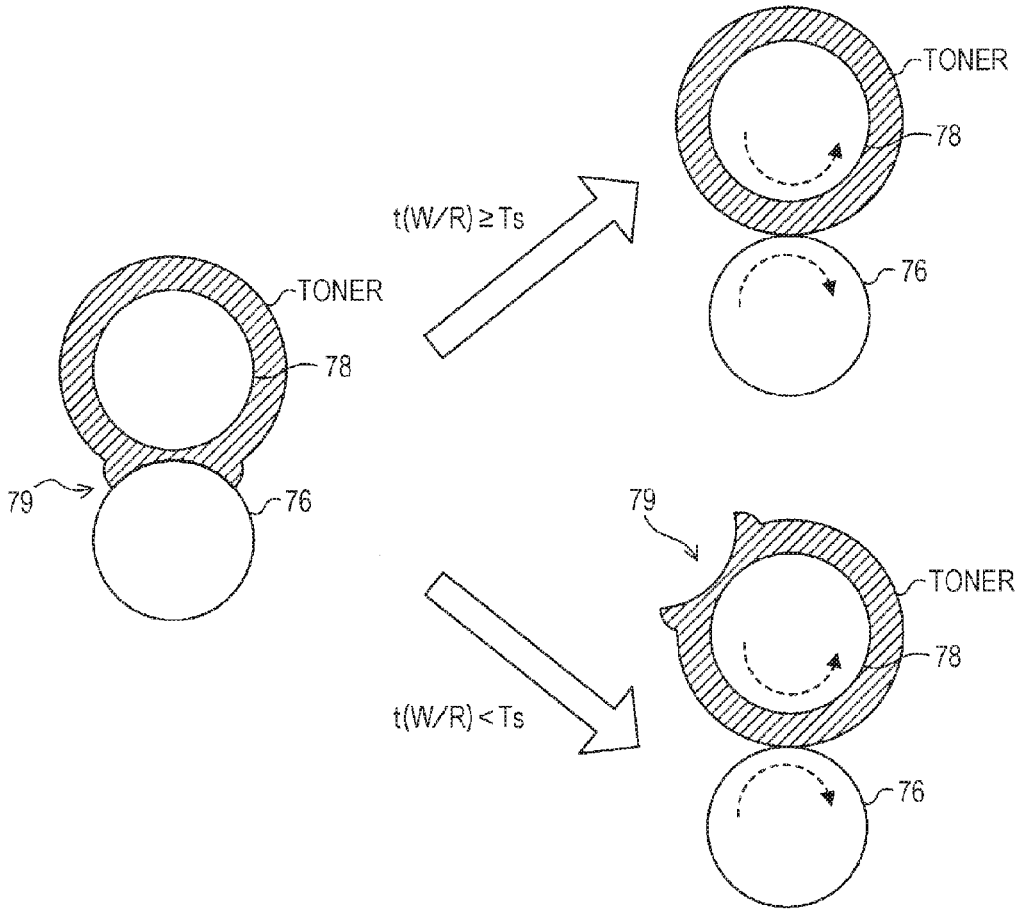
FIG. 5 is a schematic diagram for explaining toner adhesion to a collection roller.

After the imaging device 10 forms the image, the collection roller 78 collects and holds the toner. If the temperature of the collection roller 78 drops in this state, the toner thus held adheres to the surface of the collection roller 78. As illustrated in FIG. 5, the toner adheres to a portion between the collection roller 78 and the cleaning roller 76 (nip) in a shape (a shape 79) corresponding to the surface of the cleaning roller 76.

Consider a case where the collection roller 78 is rotated with the toner being adhered in this way and with the temperature t(W/R) of the collection roller 78 being lower than the softening temperature Ts of the toner. In this case, as illustrated in the case of t(W/R)<Ts in FIG. 5, the collection roller 78 is rotated with the toner still being in the adhered state in the shape 79. The shape 79 leads to an even surface of the collection roller 78. Accordingly, when the collection roller 78 is brought into contact with the cleaning roller 76, the shape 79 prevents some area of the surface of the collection roller 78 from being brought into contact with the surface of the cleaning roller 76. In the area of the surface of the cleaning roller 76 with which the collection roller 78 is not brought into contact, the toner is not collected and remains. If the cleaning roller 76 attempts to perform cleaning on the fixing roller 72 in this state, the toner remaining on the cleaning roller 76 contrarily sticks to the fixing roller 72. The toner sticking to the fixing roller 72 sticks to the sheet P, and this causes an image defect in some cases. In particular, when borderless printing is performed, cleaning of the fixing roller 72 matters. A larger amount of toner is collected and held in portions outside the widest paper-passing area of the collection roller 78 (see FIG. 2) than in the widest paper-passing area. Accordingly, as described above, this increases the probability that the adhesion causes an image defect.

In contrast, consider a case where the collection roller 78 is rotated with the temperature t(W/R) of the collection roller 78 being equal to or higher than the softening temperature Ts of the toner. As illustrated in the case of t(W/R)≥Ts in FIG. 5, the collection roller 78 is rotated with the softening toner being spread over the entire surface of the collection roller 78. The collection roller 78 does not have the uneven surface that otherwise would be caused by the shape 79, is thus brought into contact with the entire surface of the cleaning roller 76, and is restrained from having the non-contact area. This causes the toner to be appropriately collected from the surface of the cleaning roller 76, and the toner is thus restrained from remaining on the surface of the cleaning roller 76. Accordingly, the image defect as described above is restrained.

In the imaging device 10 of the exemplary embodiment, after the temperature of the collection roller 78 becomes equal to or higher than the softening temperature Ts of the toner, an image (toner image) is formed or at least fixed by the fixing device 70.

If the temperature t(W/R) is lower than the softening temperature Ts in step S112, the judgment has a negative result, and the process moves to step S114. In step S114, the controller 32 turns on the heater 84 and heats the fixing roller 72. In subsequent step S116, the controller 32 idles the fixing roller 72 for a predetermined period of time, and the process thereafter returns to step S112. If the fixing roller 72 has been rotated, the fixing roller 72 is maintained in a standby state in step S116 until the predetermined period of time elapses. Note that the predetermined period of time is a time taken for the temperature t(W/R) of the collection roller 78 to increase after transmission of the heat of the fixing roller 72 to the collection roller 78 and is in advance obtained based on experiments or the like.

If the temperature t(W/R) of the collection roller 78 is equal to or higher than the softening temperature Ts of the toner, the judgment has an affirmative result, and the process moves to step S118. In step S118, the controller 32 judges whether the temperature t(W/R) is lower than a melt temperature Tm of the toner. If the temperature of the collection roller 78 is equal to or higher than the melt temperature Tm of the toner, the storage modulus of the collection roller 78 for the toner is lowered. The toner is not held on the collection roller 78 and may flow backwards to the cleaning roller 76. That is, if the temperature t(W/R) of the collection roller 78 is equal to or higher than the melt temperature Tm of the toner, the toner collected by the collection roller 78 may be melted and flow backwards to the cleaning roller 76. The backwards flowing toner sticks to the fixing roller 72, and the toner sticking to the fixing roller 72 sticks to the sheet P. This may cause an image defect.

In the imaging device 10 of the exemplary embodiment, a state where the storage modulus of the collection roller 78 takes on a value sufficient to hold the toner is taken into consideration. If the temperature t(W/R) of the collection roller 78 is lower than the melt temperature Tm of the toner, an image (toner image) is formed or at least fixed by the fixing device 70.

If the temperature t(W/R) is not lower than the melt temperature Tm in step S118, the judgment has a negative result, and the process moves to step S120. In step S120, the controller 32 increments the variable No by one (No=No+1). In subsequent step S122, the controller 32 judges whether the variable No is larger than a predetermined constant K1 so as to control the iteration of the steps (loop). If the variable No is equal to or smaller than the constant K1, the judgment has a negative result, and the process moves to step S124.

In step S124, the controller 32 turns off the heater 84 and stops heating the fixing roller 72. If the heater 84 has been turned off, the controller 32 maintains the off state in step S124. In subsequent step S126, the controller 32 idles the fixing roller 72 for a predetermined period of time, and the process thereafter returns to step S104. If the fixing roller 72 has been rotated, the fixing roller 72 is maintained in a standby state in step S126 until the predetermined period of time elapses. Note that the predetermined period of time is a time taken to lower the temperature of the collection roller 78 and is in advance obtained based on experiments or the like. The period of time for the idling in step S126 may be equal to or different from that for the idling of the fixing roller 72 in step S116.

If the variable No is larger than the constant K1 in step S122, the judgment has an affirmative result, and the process moves to step S128. In step S128, the controller 32 decreases a process speed for forming the image (toner image).

In steps S104 to S118 described above, the heater 84 is turned on or off to adjust the temperature t(H/R) of the fixing roller 72 and the temperature t(W/R) of the collection roller 78. However, in some cases, the adjustment is not performed sufficiently, and the iteration of the steps (loop) is continuously performed. In such cases (where the variable No exceeds the predetermined constant K1), the imaging device 10 of the exemplary embodiment performs the temperature adjustment by decreasing the process speed for forming the image (toner image), not by using the heater 84. In the imaging device 10 of the exemplary embodiment, the temperature at which the fixing device 70 fixes the toner is lowered by decreasing the process speed, and the iteration of the steps described above (loop) is avoided by lowering the temperature of the fixing roller 72.

In subsequent step S130, the controller 32 changes the lower limit Tlow of the temperature of the fixing roller 72 to a lower limit for a case where the process speed is decreased. Specifically, a temperature Tp by which the process speed is to be decreased in accordance with a decreased process speed is in advance obtained based on experiments or the like. The controller 32 subtracts the temperature Tp from the current lower limit Tlow (Tlow=Tlow−Tp). The controller 32 also changes the upper limit Thi of the temperature of the fixing roller 72 to an upper limit for a case where the process speed is decreased. Specifically, the controller 32 subtracts the temperature Tp from the current upper limit Thi (Thi=Thi−Tp). After step S130 is complete, the process returns to step S104.

If the temperature t(W/R) is lower than the melt temperature Tm in step S118, the judgment has an affirmative result, and the process moves to step S132. In step S132, the controller 32 starts image formation. In the imaging device 10, an image is formed on the sheet P in the image formation process described above, and the sheet P is discharged to the outside (the discharging section 28) of the imaging device 10.

In subsequent step S134, the controller 32 judges whether to terminate the image formation. If the formation of all of images for which image forming instructions are received to start the temperature control process is complete, or if an instruction for terminating the image formation (forced termination) is received from a user or the like, the controller 32 judges that the image formation is to be terminated. If the image formation is not to be terminated, the judgment has a negative result, the process returns to step S102, and steps S104 to S130 are repeated.

If the image formation is to be terminated, the judgment has an affirmative result, and the process moves to step S136. In step S136, the controller 32 turns off the heater 84 and stops heating the fixing roller 72. If the heater 84 has been turned off, the controller 32 maintains the off state in step S136.

In subsequent step S138, the controller 32 stops the motors 110, 112, 114, and 116 of the fixing device 70. The rotation of the fixing roller 72, the pressure roller 74, the cleaning roller 76, and the collection roller 78 is thereby stopped.

In subsequent step S140, the controller 32 judges whether the temperature t(W/R) of the collection roller 78 is lower than a temperature that is 5 degrees higher than the softening temperature Ts of the toner (t(W/R)<Ts+5). As long as the temperature t(W/R) is equal to or higher than the temperature of the softening temperature Ts plus 5 degrees, the judgement has a negative result. If the temperature t(W/R) is lower than the temperature of the softening temperature Ts plus 5 degrees, the judgment has an affirmative result, and the process moves to step S142.

In step S142, the controller 32 starts the motors 110, 112, 114, and 116 of the fixing device 70. The fixing roller 72, the pressure roller 74, the cleaning roller 76, and the collection roller 78 are thereby rotated again.

As described above, when the imaging device 10 forms an image, the collection roller 78 collects and holds the toner. If the collection roller 78 stops rotating at a high temperature with the toner being held thereon, the toner adheres to the portion (nip) between the collection roller 78 and the cleaning roller 76 in the shape (shape 79) corresponding to the surface of the cleaning roller 76 as described above. The adhesion of the toner in the shape 79, in some cases, prevents the cleaning roller 76 and the collection roller 78 from rotating when image formation is started next time.

In the imaging device 10 of the exemplary embodiment, when the image formation is to be terminated, the collection roller 78 and the cleaning roller 76 are rotated after the temperature of the collection roller 78 becomes around the softening temperature and until the temperature is lowered to a predetermined temperature. That is, the collection roller 78 and the cleaning roller 76 are rotated while the toner is kept transformable and not easy to flow backwards. As illustrated in the case of t(W/R)≥Ts in FIG. 5, unevenness of the shape 79 of the toner held on the surface of the collection roller 78 is reduced, and the toner spreads over the entire surface. Accordingly, the rotation of the cleaning roller 76 and the collection roller 78 is restrained from being prevented when image formation is started next time.

In the exemplary embodiment, in steps S138 to S142, the motors of the fixing device 70 are turned off, and if the temperature t(W/R) of the collection roller 78 becomes lower than the temperature of the softening temperature Ts of the toner plus 5 degrees, the motors are turned on again. However, steps S138 to S142 may be omitted. The motors of the fixing device 70 may be kept on. However, for example, if the imaging device 10 is turned off while the control is being performed, the rotation of the collection roller 78 may be stopped with the temperature of the collection roller 78 still being high. Accordingly, it is preferable that the temperature of the collection roller 78 be lowered in a short time. It is thus preferable that the motors of the fixing device 70 be turned off as in the temperature control process according to the exemplary embodiment because the temperature of the collection roller 78 is lowered in a shorter time.

In subsequent step S144, the controller 32 judges whether the temperature t(W/R) of the collection roller 78 is higher than a temperature that is 5 degrees lower than the softening temperature Ts of the toner (t(W/R)>Ts−5). As long as the temperature t(W/R) is higher than the temperature of the softening temperature Ts minus 5 degrees, the judgment has an affirmative result. If the temperature t(W/R) is equal to or lower than the temperature of the softening temperature Ts minus 5 degrees, the judgment has a negative result, and the process moves to step S146.

In subsequent step S146, the controller 32 turns off the motors of the fixing device 70 and terminates the temperature control process. In the temperature control process according to the exemplary embodiment as described above, if the temperature t(W/R) of the collection roller 78 is within a range of plus or minus 5 degrees of the softening temperature Ts of the toner after the image formation is complete, the motors of the fixing device 70 (at least the motor 116 of the collection roller 78) are kept on. However, the range of plus or minus 5 degrees of the softening temperature Ts of the toner is an example. The temperature range, a time, or the like for keeping the motors of the fixing device 70 on after the end of the image processing is not particularly limited and may be experimentally obtained in advance.

Figure 6:
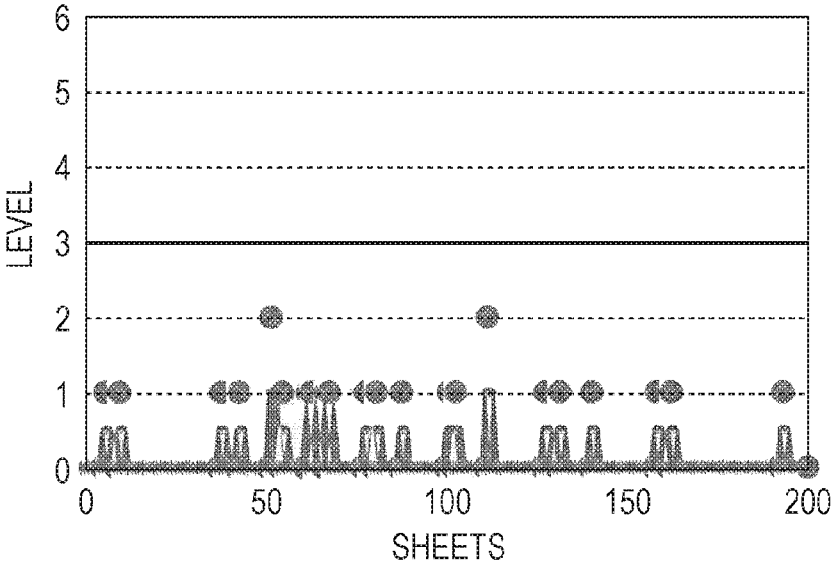
FIG. 6 is a graph for evaluating image defects in images (sheets P having the images formed thereon) formed by the image forming apparatus according to the first exemplary embodiment.
Figure 7:
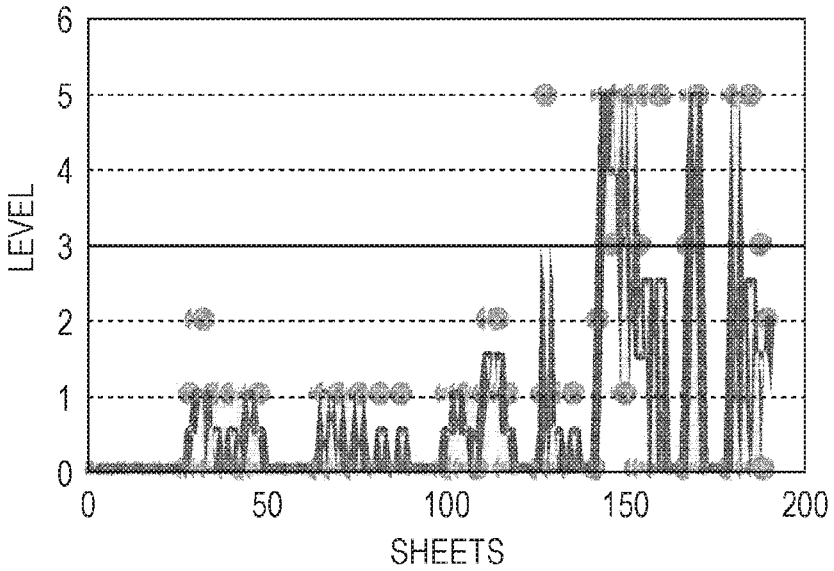
FIG. 7 is a graph, in a comparative example, of evaluation of image defects in images formed by an image forming apparatus without performing the temperature control process according to the first exemplary embodiment.
Figure 8:
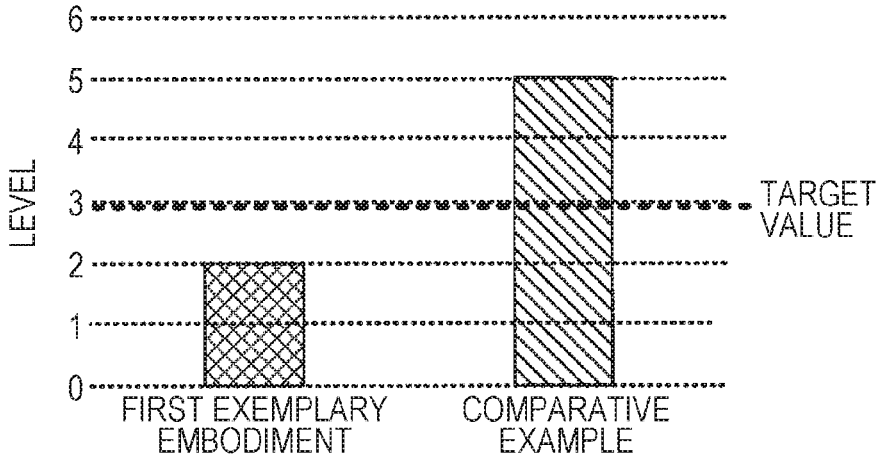
FIG. 8 is a graph illustrating the worst-grade values (the highest values) in the first exemplary embodiment and the comparative example, respectively.

FIG. 6 illustrates a graph of evaluation of image defects of images (the sheets P having the images formed thereon) formed by the imaging device 10 of the exemplary embodiment. FIG. 7 illustrates a graph, in a comparative example, of evaluation of image defects in images formed by an image forming apparatus without performing the temperature control process according to the exemplary embodiment. FIG. 8 illustrates a graph of the worst-grade values (the highest values) in the exemplary embodiment and the comparative example, respectively. In each graph illustrated in FIGS. 6 and 7, the horizontal axis represents the number of sheets P having images formed thereon, and the vertical axis represents the level of a smear (defect). Note that whether each sheet P having an image thereon has a smear is checked by visual observation and is assigned a level. The higher the level is, the dirtier the smear is. Generally, if the smear level is equal to or higher than Level 3 assigned to occurrence of clusters of spot smears in a diameter $\phi$ of 0.2 mm, the image defect causes a problem. The smear level is thus preferably lower than Level 3, and Level 3 is set as a target value.

As illustrated in FIGS. 6 to 8, it is understood that if the temperature control process according to the exemplary embodiment is not executed, as the number of sheets P having images formed thereon is increased, the level of image defects in the images becomes high, that is, smears are increased. In contrast, it is understood that if the imaging device 10 of the exemplary embodiment executes the temperature control process, there is only a slight change in the level of image defects in images despite an increase in the number of sheets P having the images formed thereon, that is, smears are not increased, and the level is kept lower than Level 3 that is the target value.

Second Exemplary Embodiment

A second exemplary embodiment will be described. The same components as those of the imaging device 10 according to the first exemplary embodiment are denoted by the same reference numerals, and detailed description is omitted.

Figure 9:
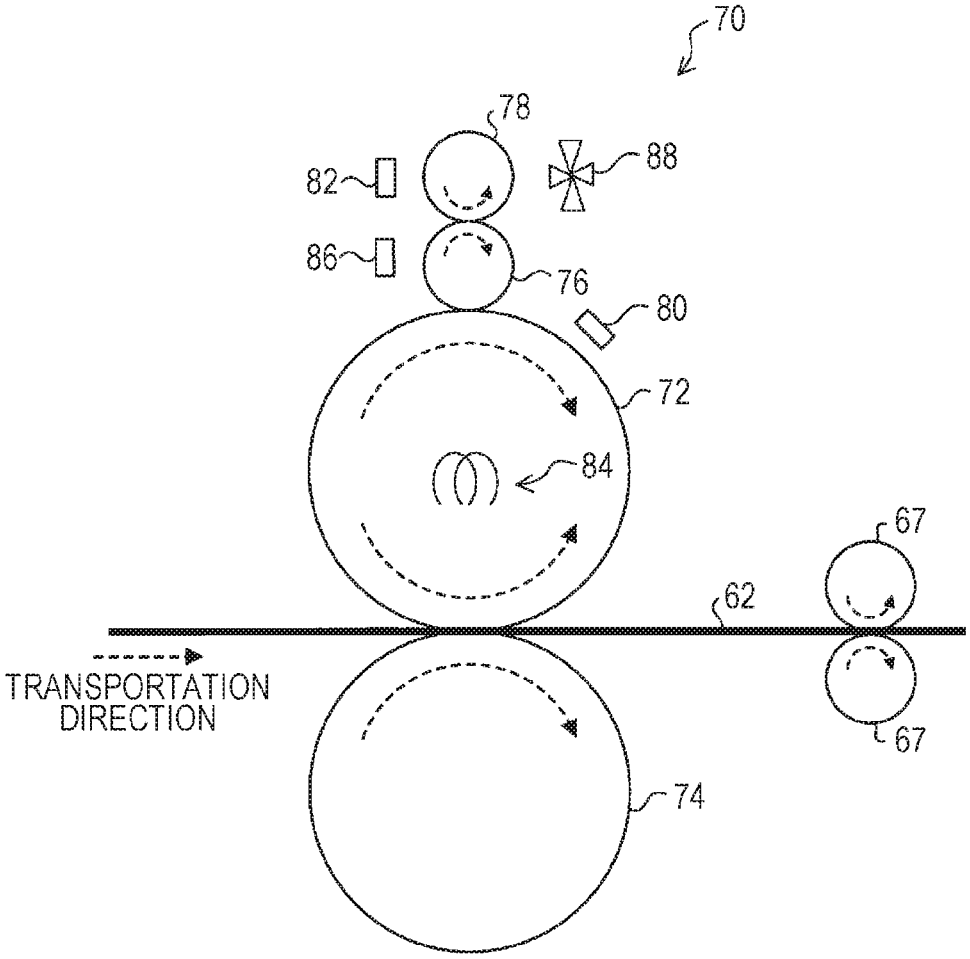
FIG. 9 is a diagram schematically illustrating a configuration overview of a fixing device of an image forming apparatus according to a second exemplary embodiment.

As illustrated in FIG. 9, an imaging device 10 of the second exemplary embodiment is different from the imaging device 10 of the first exemplary embodiment in that the fixing device 70 includes a temperature sensor 86 that detects the temperature of the cleaning roller 76 and a cooling fan 88 that cools the collection roller 78.

The temperature sensor 86 detects the temperature of the surface of the cleaning roller 76. In the exemplary embodiment, the temperature sensor 86 detects the temperature of a portion outside an area (widest paper-passing area) of the surface of the cleaning roller 76 through which the sheet P passes. More specifically, the detection position is located upstream of the nip (contact portion) with the collection roller 78 in a direction of the rotation of the cleaning roller 76 and in the rear portion of the imaging device 10. The temperature sensor 86 is not particularly limited, either, as long as the temperature sensor 86 detects the temperature of the surface of the cleaning roller 76. However, like the temperature sensors 80 and 82, the temperature sensor 86 preferably detects a temperature in such a manner as not to be in contact with the cleaning roller 76. For example, the temperature sensor 86 is preferably an infrared radiation thermometer or the like.

Figure 10:
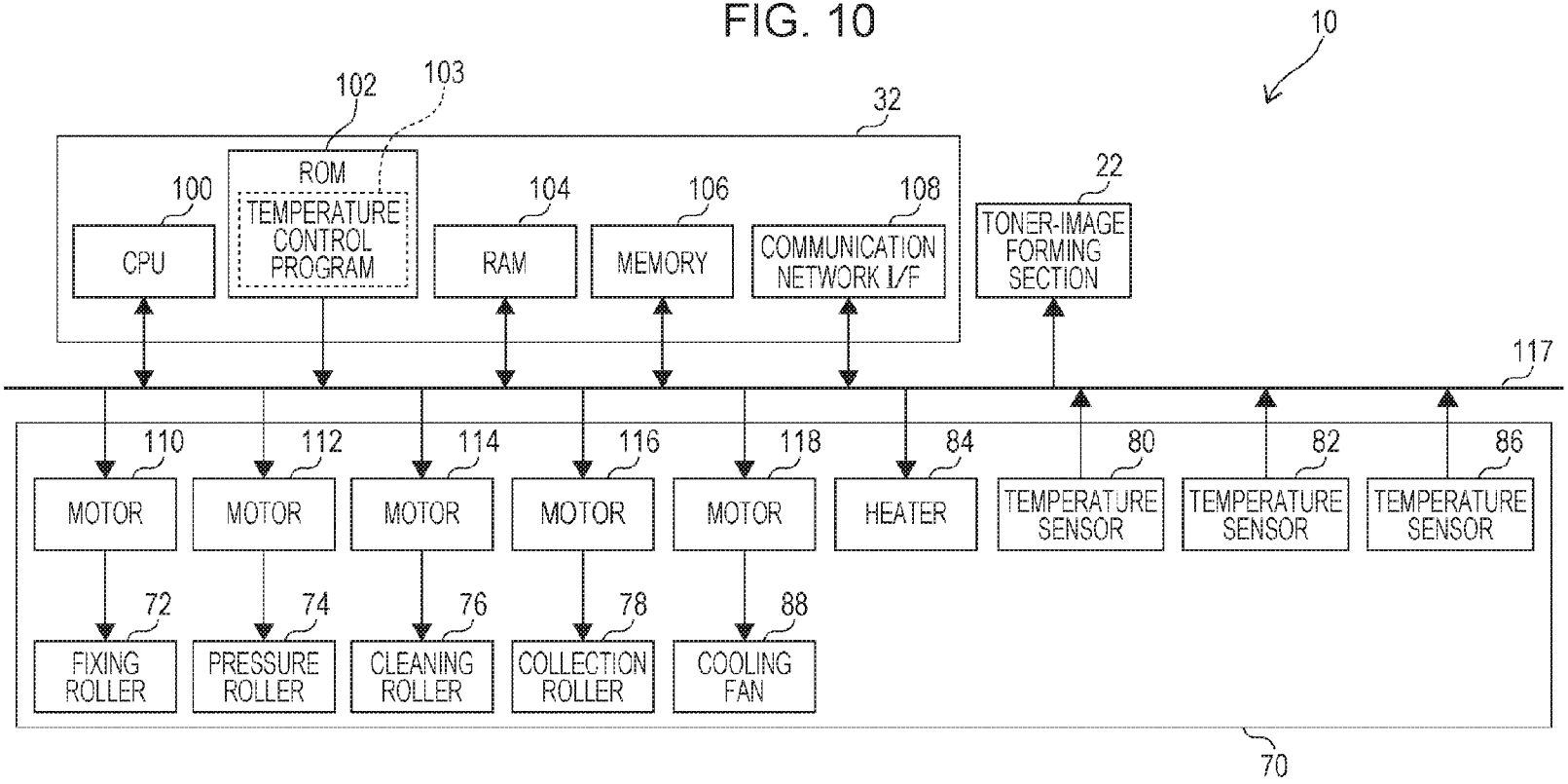
FIG. 10 is a block diagram illustrating the configuration of a principal part of an electrical system of the image forming apparatus according to the second exemplary embodiment.

The cooling fan 88 is disposed to face the surface of the collection roller 78 and rotated by a motor 118 (see FIG. 10). The cooling fan 88 is rotated and thereby sends air to cool the collection roller 78. Note that the cooling fan 88 and the motor 118 of the exemplary embodiment are each an example of a cooling device for cooling the collection roller 78. The cooling device is not limited to that in the exemplary embodiment as long as the cooling device cools the collection roller 78.

As in the configuration of a principal part of an electrical system of the imaging device 10 of the exemplary embodiment illustrated in FIG. 10, the CPU 100, the ROM 102, the RAM 104, the memory 106, the communication network I/F 108, the motors 110, 112, 114, 116, and 118, the temperature sensors 80, 82, and 86, and the heater 84 of the imaging device 10 of the exemplary embodiment are connected to each other through the bus 117 including the address bus, the data bus, and the control bus, and other buses.

The CPU 100 controls the rotation of the cooling fan 88 by controlling the motor 118 and thereby controls cooling of the collection roller 78. Further, the CPU 100 acquires a detection signal output from the temperature sensor 86 and thereby detects a temperature t(C/R) of the cleaning roller 76.

Figure 11:
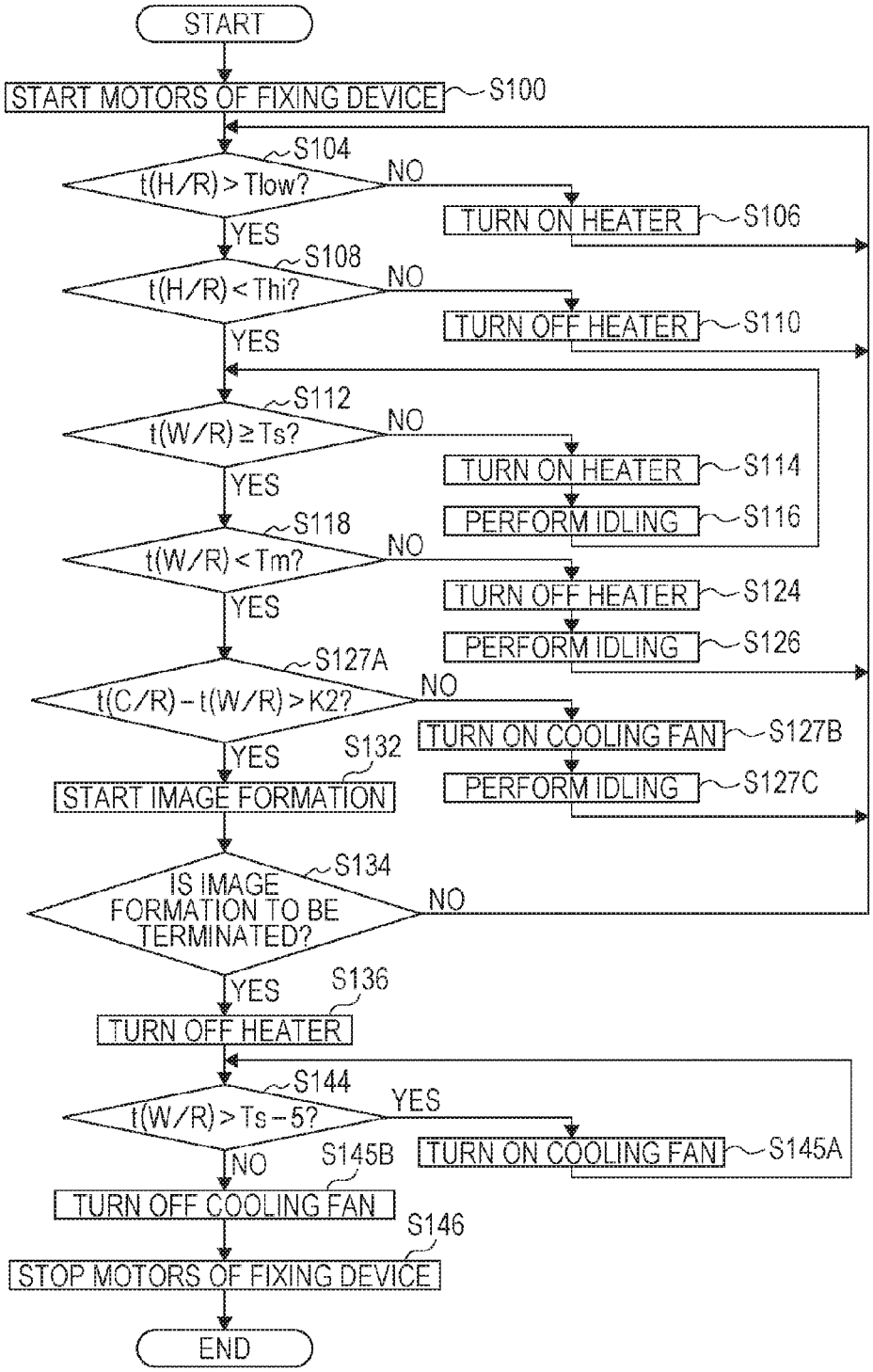
FIG. 11 is a flowchart illustrating the flow of a temperature control process executed by a controller of the image forming apparatus according to the second exemplary embodiment.

Subsequently, the actions of the imaging device 10 of the exemplary embodiment will be described. FIG. 11 is a flowchart illustrating the flow of a temperature control process for the fixing device 70 executed by the controller 32 according to the exemplary embodiment. Since the temperature control process executed by the imaging device 10 of the exemplary embodiment includes the same steps as those in the temperature control process (see FIG. 4) executed in the imaging device 10 of the first exemplary embodiment, only different steps will be described.

As illustrated in FIG. 11, the temperature control process according to the exemplary embodiment does not have step S102 (see FIG. 4) in the temperature control process in the first exemplary embodiment. Accordingly, after the controller 32 starts the motors of the fixing device 70 in step S100, the process moves to step S104.

The temperature control process according to the exemplary embodiment does not have steps S120, S122, S128, and S130 (see FIG. 4) in the temperature control process in the first exemplary embodiment. Accordingly, if the judgment has a negative result in step S118, the process moves to step S124.

The temperature control process according to the exemplary embodiment has steps S127A, S127B, and S127C before step S132. Accordingly, if the judgment has an affirmative result in step S118, the process moves to step S127A.

In step S127A, the controller 32 detects the temperature t(C/R) of the cleaning roller 76 and the temperature t(W/R) of the collection roller 78 and judges whether a difference between the temperature t(C/R) of the cleaning roller 76 and the temperature t(W/R) of the collection roller 78 is larger than a constant K2 predetermined to control the backflow of the toner.

The toner is easier to melt at a high surface temperature than at a low surface temperature and thus sticks to an area that has a lower surface temperature than the other area in the nip between the cleaning roller 76 and the collection roller 78. When heating or the like of the fixing roller 72 increases the temperature t(W/R) of the collection roller 78 and when a difference from the temperature t(C/R) of the cleaning roller 76 becomes lower than the constant K2, the storage modulus of the collection roller 78 for the toner may be decreased, and the toner may flow backwards from the collection roller 78 to the cleaning roller 76. The backwards flowing toner sticks to the fixing roller 72, and the toner sticking to the fixing roller 72 sticks to the sheet P. This may cause an image defect.

In the imaging device 10 of the exemplary embodiment, the constant K2 for the difference between the temperature t(W/R) of the collection roller 78 and the temperature of the temperature t(C/R) of the cleaning roller 76 is in advance experimentally obtained to maintain the storage modulus sufficient to hold the toner. The temperature of the collection roller 78 is controlled such that the difference between the temperature t(C/R) of the cleaning roller 76 and the temperature t(W/R) of the collection roller 78 is larger than the constant K2.

If the judgment has a negative result in step S127A, the process moves to step S127B. In step S127B, the controller turns on the cooling fan 88. Specifically, the controller 32 turns on the motor 118 to rotate the cooling fan 88. If the cooling fan 88 has been turned on, the controller 32 maintains the on state in step S127B. The temperature of the collection roller 78 is thereby lowered.

In subsequent step S127C, the controller 32 idles the fixing roller 72 for a predetermined period of time, and the process thereafter returns to step S104. If the fixing roller 72 has been rotated, the fixing roller 72 is maintained in a standby state in step S127C until the predetermined period of time elapses. Note that the predetermined period of time is a time taken to lower the temperature of the collection roller 78 and is in advance obtained based on experiments or the like. The period of time for the idling in step S127C may be equal to or different from any of the periods of time for the idling of the fixing roller 72 in steps S116 and S126.

If the judgment has an affirmative result in step S127A, the process moves to step S132. If the cooling fan 88 has been turned on before the controller 32 starts the image formation in step S132, the cooling fan 88 may be turned off.

Since the temperature control process according to the exemplary embodiment does not have steps S138 to S142 (see FIG. 4) in the temperature control process in the first exemplary embodiment, the process moves to step S144 after step S136.

In the temperature control process according to the exemplary embodiment, step S145A or step S145B is performed after step S144.

If the judgment has an affirmative result in step S144 in the temperature control process according to the exemplary embodiment, the process moves to step S145A. In step S145A, the controller 32 turns on the cooling fan 88 as in step S127B, the process thereafter returns to step S144. The controller 32 thereby lowers the temperature of the collection roller 78. As described above in the exemplary embodiment, the cooling fan 88 is turned on to lower the temperature of the collection roller 78, and the rotation of the collection roller 78 is restrained from being stopped with the temperature of the collection roller 78 being still high. The imaging device 10 of the exemplary embodiment thereby restrains the rotation of the cleaning roller 76 and the collection roller 78 from being prevented when image formation is started next time.

If the judgment has an affirmative result in step S144, the process moves to step S145B. In step S145B, the controller 32 turns off the cooling fan 88, and the process thereafter moves to step S146. If the cooling fan 88 has been turned off, the controller 32 maintains the off state.

Figure 12:
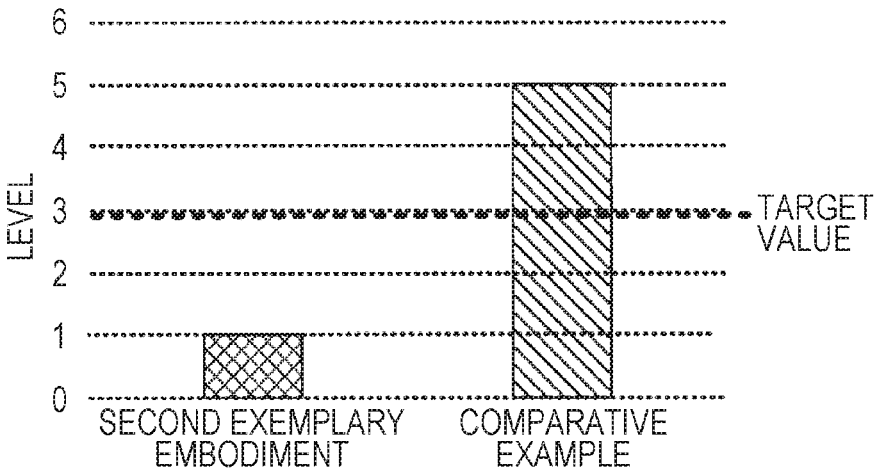
FIG. 12 is a graph illustrating the worst-grade values (the highest values) in the second exemplary embodiment and the comparative example, respectively.

FIG. 12 illustrates a graph of the worst values (the highest values) in level of image defects in the exemplary embodiment and the comparative example, respectively. The image defects have respectively occurred in an image (on the sheet P having the image formed thereon) formed by the imaging device 10 of the exemplary embodiment and in an image formed by an image forming apparatus in the comparative example without performing the temperature control process according to the exemplary embodiment. As in the first exemplary embodiment in FIGS. 6 to 8, the higher the level is, the dirtier a smear is. The smear level is thus preferably lower than Level 3, and Level 3 is set as the target value.

As illustrated in FIG. 12, it is understood that if the temperature control process according to the exemplary embodiment is not executed, the level of the image defect in the image is high and exceeds the target value. In contrast, it is understood that if the imaging device 10 of the exemplary embodiment executes the temperature control process, the level of the image defect in the image is lower than Level 3 that is the target value.

It goes without saying that each exemplary embodiment is an example and may be changed without departing from the spirit of the exemplary embodiment. For example, the exemplary embodiments described above may be combined.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A fixing device comprising:

a fixing member that fixes, on a recording medium, a toner image formed on the recording medium;

a first roller that performs cleaning of toner sticking to a surface of the fixing member;

a second roller that collects the toner sticking to a surface of the first roller;

a detector that detects a temperature of the second roller; and an adjustment unit that adjusts the temperature of the second roller on a basis of a result of detection performed by the detector.

2. The fixing device according to claim 1, wherein the adjustment unit includes a cooling device that cools the second roller.

3. The fixing device according to claim 1, wherein the adjustment unit causes the temperature of the second roller to be higher than a softening temperature of the toner before the toner image is formed on the recording medium.

4. The fixing device according to claim 1, wherein when the toner image is formed on the recording medium, the adjustment unit adjusts the temperature of the second roller to prevent a storage modulus of the second roller for the toner from being lower than a predetermined value or to prevent the temperature of the second roller from being lower than a melt temperature of the toner.

5. The fixing device according to claim 1, further comprising:

a different detector that detects a temperature of the first roller, wherein the adjustment unit adjusts the temperature of the second roller such that the temperature of the first roller is higher than the temperature of the second roller and such that a difference between the temperature of the first roller and the temperature of the second roller causes a storage modulus of the second roller for the toner to be kept equal to or higher than a predetermined value.

6. The fixing device according to claim 1, wherein if forming the toner image on the recording medium is complete, the adjustment unit rotates the second roller while the temperature of the second roller is within a predetermined temperature range including a softening temperature of the toner or in a predetermined period of time in which the temperature of the second roller is within the predetermined temperature range including the softening temperature of the toner.

7. An image forming apparatus comprising:

a toner image forming unit that forms a toner image on a recording medium; and the fixing device according to claim 1, the fixing device fixing, on the recording medium, the toner image formed on the recording medium.

8. A non-transitory computer readable medium storing a program causing a computer to execute a process comprising:

fixing, on a recording medium, a toner image formed on the recording medium;

performing cleaning of toner sticking to a surface of a fixing member;

collecting the toner sticking to a surface of a first roller;

detecting a temperature of a second roller; and adjusting the temperature of the second roller on a basis of a result of the detecting.

* * * * *